US006831614B2

(12) United States Patent
Hsiao

(10) Patent No.: US 6,831,614 B2
(45) Date of Patent: Dec. 14, 2004

(54) ARRAY PLANAR ANTENNA STRUCTURE

(75) Inventor: Jason Hsiao, Taipei (TW)

(73) Assignee: Gemtek Technology Co., Ltd., Hukou Hsinchu (TW)

( * ) Notice: Subject to any disclaimer, the term of this patent is extended or adjusted under 35 U.S.C. 154(b) by 0 days.

(21) Appl. No.: 10/435,558

(22) Filed: May 12, 2003

(65) Prior Publication Data

US 2003/0214445 A1 Nov. 20, 2003

(30) Foreign Application Priority Data

May 14, 2002 (TW) ..... 91206863 U

(51) Int. Cl.[7] ..... H01Q 1/38; H01Q 21/10

(52) U.S. Cl. ..... 343/795; 343/700 MS

(58) Field of Search ..... 343/795, 700 MS, 343/810–822

(56) References Cited

U.S. PATENT DOCUMENTS 6,377,227 B1 * 4/2002 Zhu et al. ..... 343/795

* cited by examiner

*Primary Examiner*—Michael C. Wimer

(57) ABSTRACT

An array planar antenna structure comprises a substrate, wherein a plurality of planar antennas which respectively have a signal end and a ground end are mounted on the top surface of the substrate, a feeding micro strip conducting wire which is mounted on the surface of the substrate and has a plurality of feeding conducting wires respectively connected with each signal end of the planar antennas, and a ground micro strip conducting wire which is parallel to the feeding micro strip conducting wire and has a plurality of ground conducting wires respectively connected with each ground end of the planar antennas. The array planar antenna structure of this invention is characterized in that when the feeding conducting wires between the ground conducting wires of the two neighboring planar antennas, the ground micro strip conducting wire between the two neighboring ground conducting wires is mounted on the bottom surface of the substrate and connected with the ground conducting wires through respective conducting apertures.

11 Claims, 5 Drawing Sheets

ARRAY PLANAR ANTENNA STRUCTURE

FIELD OF THE INVENTION

The present invention relates to a miniaturized micro strip antenna structure design and more particularly to an array planar antenna structure.

BACKGROUND OF THE INVENTION

Rapid innovation and development upon wireless communication technology have made mobile communication products as one of the mainstream products nowadays. These mobile communication products include mobile phones, PDA, notebook computers, etc. They can couple with proper communication modules for linking to the Internet, transmitting and receiving E-mail, and obtaining the instant information (such as news, stocks quotations, and so on) for sharing resources and transmitting data.

In the communication module, the most important and the key component is antenna. The primary function of the antenna is transmitting signals by radio waves, and the quality of transmitting is related with the structure design of antenna. Generally, if the size of antenna is bigger, the antenna can produce a better radiation field and provide a higher profit, but the bigger volume is opposite to the bigger space, used. This does not correspond to the design idea of a slim size and a light weight of most products. Thus designers work hard on product design, and wish to design an antenna structure with a slim size and a good quality.

Referring now to FIG. 1 for a micro strip dipole antenna structure, the dipole antenna 10 includes two micro strip conductors 12, forming on the surface of the dielectric substrate 14 made of nonmetal material. Each of the length of the two micro strip conductors 12 is quarter wavelength (¼ λ), and the interior end of one of the micro strip conductors 12*a* is a signal end 16. The interior end of another micro strip conductor 12*b* is a ground end 18. The signal end 16 and the ground end 18 are connected respectively with the source of electricity 20. The current circuit flows from the signal end 16 to the outer side, and flows back from another outer side to the ground end 18, which forms a half wavelength radiation field between the two outer sides. Nevertheless, because the conventional technique cannot provide an omni-directional radiation field and produces low profit, thus the conventional micro strip planar antenna structure cannot provide a better quality of transmitting signals.

SUMMARY OF THE INVENTION

The primary object of the invention is to provide an array planar antenna structure for providing an omni-directional radiation field, so that a better quality of transmitting the signals can be provided.

The array planar antenna structure of this invention comprises a substrate, a feeding micro strip conducting wire, and a ground micro strip conducting wire. A plurality of planar antennas, which respectively have a signal end and a ground end, are mounted on the upper surface of the substrate. The feeding micro strip conducting wire, which is mounted on the upper surface of the substrate, has a plurality of feeding conducting wires connected respectively with each signal end of the planar antennas. The ground micro strip conducting wire, which is parallel to the feeding micro strip conducting wire, has a plurality of ground conducting wires respectively connected with each ground end of the planar antennas. The array planar antenna structure of this invention is characterized in that, when the feeding conducting wires between the ground conducting wires of the two neighboring planar antennas, the ground micro strip conducting wire between the two neighboring ground conducting wires is mounted on the bottom surface of the substrate. The ground micro strip conducting wire is connected with the ground conducting wires through respective conducting apertures. The planar antennas are arranged by strung in row along the substrate, and the two neighboring planar antennas are adjusted by an appropriate distance according to the type of the required radiation field, and every length of the two micro strip conductors of the planar antenna is the multiple of quarter wavelength (¼ λ), and a half wavelength radiation field can be produced after the current passing by.

As the convention is formed by stringing up a plurality of planar antennas, the convention can not only increase the radiation field of the planar but also promote the profit. Besides, this invention can put two array planar antennas symmetrically and abreast. Thus, the invention can not only produce an omni-directional radiation field, but also promote profit by increasing the number of the planar antennas in a unit area.

The foregoing, as well as additional objects, features and advantages of the invention will be more readily apparent from the following detailed description, which proceeds with reference to the accompanying drawings.

DESCRIPTION OF THE PREFERRED EMBODIMENTS

The invention aims at providing an array planar antenna structure, in which a plurality of planar antennas strung in row are mounted on a long substrate. Thus the invention can increase the radiation field of antennas and greatly promote the profit, and then provide a better quality of transmitting signals.

Figure 1:
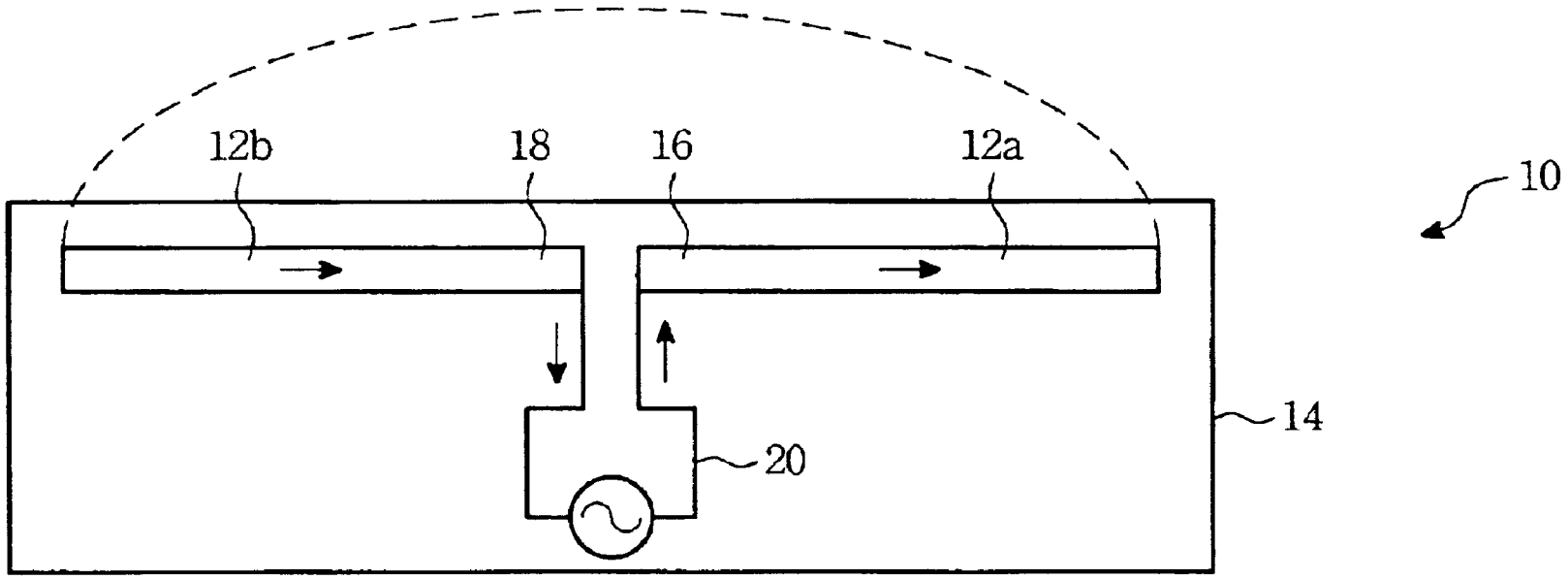
FIG. 1 (Prior Art)
FIG. 1 a schematic view of a conventional micro strip planar antenna structure.
Figure 2:
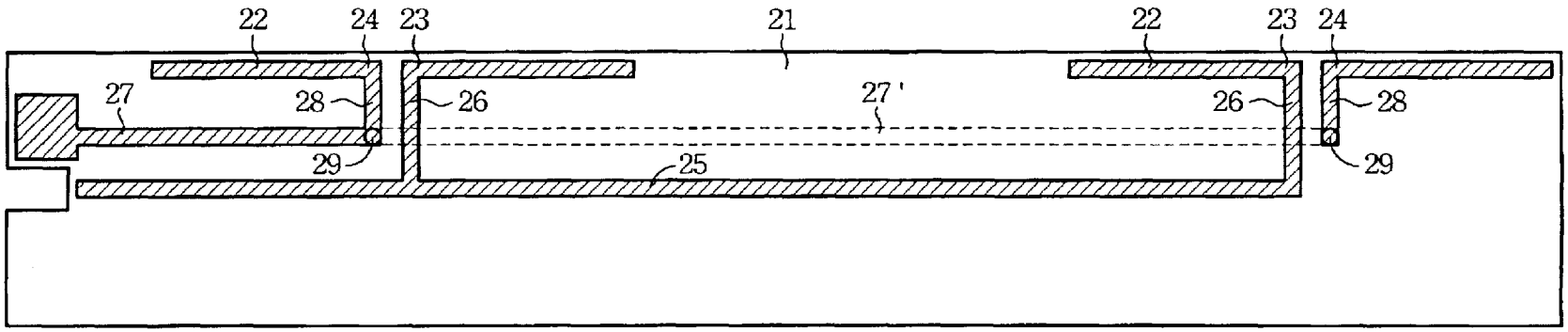
FIG. 2 is a schematic view of the first embodiment of the array planar antenna structure of the invention.

Referring now to FIG. 2 for the first embodiment of the invention, the array planar antenna structure of the invention includes a substrate 21, which is a long plank structure of dielectric material, and where a plurality of planar antennas 22 are mounted on its' upper surface. Every planar antenna 22 is formed by two micro strip conductors, each of whose length is a multiple of ¼ wavelength, and has a signal end 23 and a ground end 24 mounted thereon. The planar antennas 22 are strung in row along the direction of the substrate 21; between any two of the neighboring planar antennas 22, an appropriate distance exists. A feeding micro strip conducting wire 25, which is mounted on the surface of the substrate 21, is connected with each signal end 23 of the planar antenna 22 by the feeding conducting wires 26, and a ground micro strip conducting wire 27, which is parallel to the feeding micro strip conducting wire 25, is connected with each ground end 24 of the planar antenna 22 by the ground conducting wires 28.

As the ground micro strip conducting wire 27 is parallel to the feeding micro strip conducting wire 25. If both of them are mounted on the upper surface of the substrate 21, when the feeding conducting wires 26 connects the feeding micro strip conducting wire 25 with the signal end 23 of the planar antenna 22, the feeding conducting wires 26 will cross the ground micro strip conducting wire 27, and result in a short circuit problem. For avoiding the short circuit problem, the embodiment is characterized by that when the ground conducting wires 28 of two neighboring planar antennas 22 have the feeding conducting wires 26 between them. The ground micro strip conducting wires 27' of said two ground conducting wires 28 are set on the bottom surface of the substrate 21, and connected with ground conducting wires 28 by the conducting apertures 29. Therefore, on condition that the length of the substrate 21 is permitted, according to an actual condition, a plurality of planar antennas 22 are strung in row and arranged on the surface of the substrate 21. After the feeding micro strip conducting wire 25 passed by the electric current, and after the ground micro strip conducting wires 27 connected with the ground, the planar antenna 22 produces a multiple of half wavelength radiation field.

Figure 3:
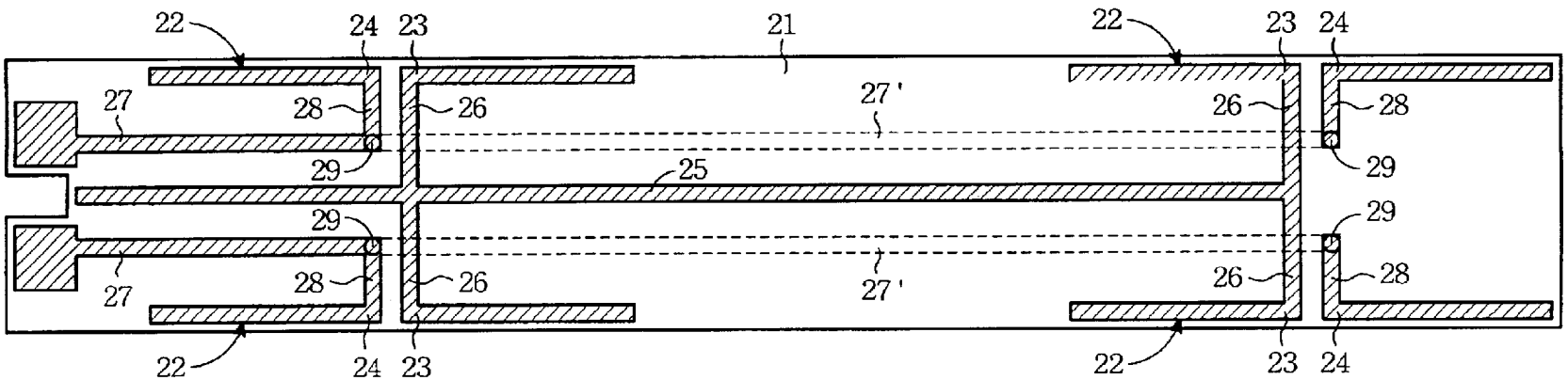
FIG. 3 is a schematic view of the second embodiment of the array planar antenna structure of the invention.

Referring now to FIG. 3 for the second embodiment of the invention, this embodiment has approximately the same design as the second embodiment. The primary difference is that the two array planar antennas of the first embodiment are combined symmetrically and abreast with the same substrate 21. The only one feeding micro strip conducting wire 25 is mounted in the middle of the long substrate 21 and is connected with the signal ends 24 on both sides of the planar antennas 22 by the feeding conducting wires 26. The second embodiment has two ground micro strip conducting wires 27 which are mounted on both sides of the feeding micro strip conducting wire 25 and are parallel with it. In the same way, the second embodiment can also avoid the ground micro strip conducting wire 27 connecting with the feeding conducting wires 26 and then forming a short circuit problem. When the ground conducting wires 28 of two neighboring planar antennas 22 have the feeding conducting wires 26 between them, the ground micro strip conducting wires 27' of said two ground conducting wires 28 are set on the bottom surface of the substrate 21, and connected with ground conducting wires 28 by the conducting apertures 29.

According to the second embodiment of the invention, on two sides of the substrate 21 include the planar antennas 22. Hence in the horizontal direction, because of the symmetrical structure, the invention can produce a better radiation field. Besides, the ground plate of the invention can be mounted on the bottom surface of the substrate 21, and the feeding power supply is located on the upper surface of the substrate 21. As the result, the second embodiment produces a vertical radiation field between the upper and the bottom surfaces of the substrate 21 and then gains an omni-directional radiation field. Thus, the invention can not only produce a better profit, but also gain a better quality of transmitting signals.

Figure 4:
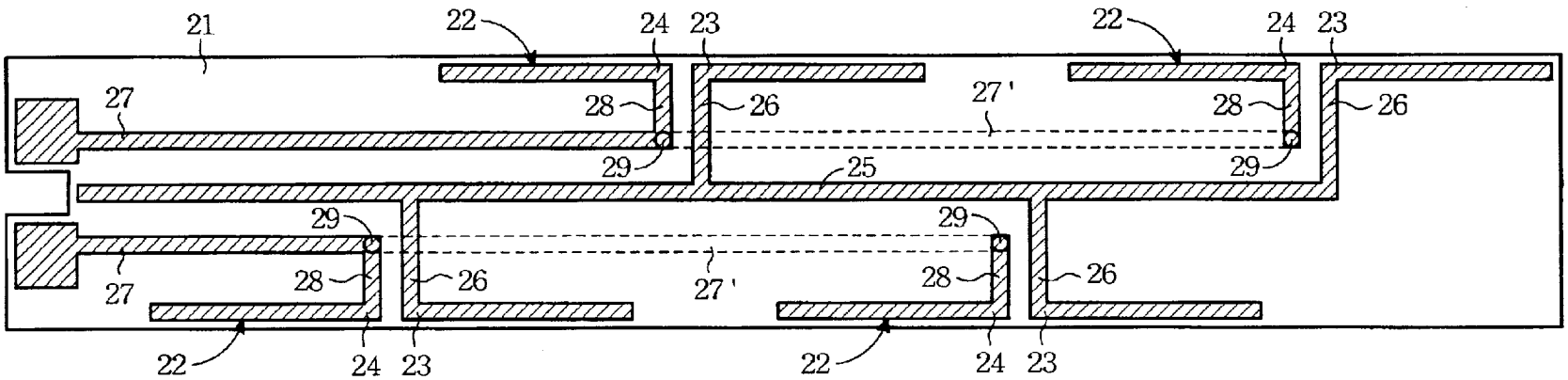
FIG. 4 is a schematic view of the third embodiment of the array planar antenna structure of the invention.

Referring now to FIG. 4 for the third embodiment of the invention, this embodiment has approximately the same design idea as the second embodiment. Only one different point is that in the second embodiment of the invention, two array planar antennas are combined symmetrically and abreast with the same substrate 21. Nevertheless, in the third embodiment, two array planar antennas are combined asymmetrically but abreast with the same substrate, and other design ideas of this embodiment and the second one are the same.

Figure 5:
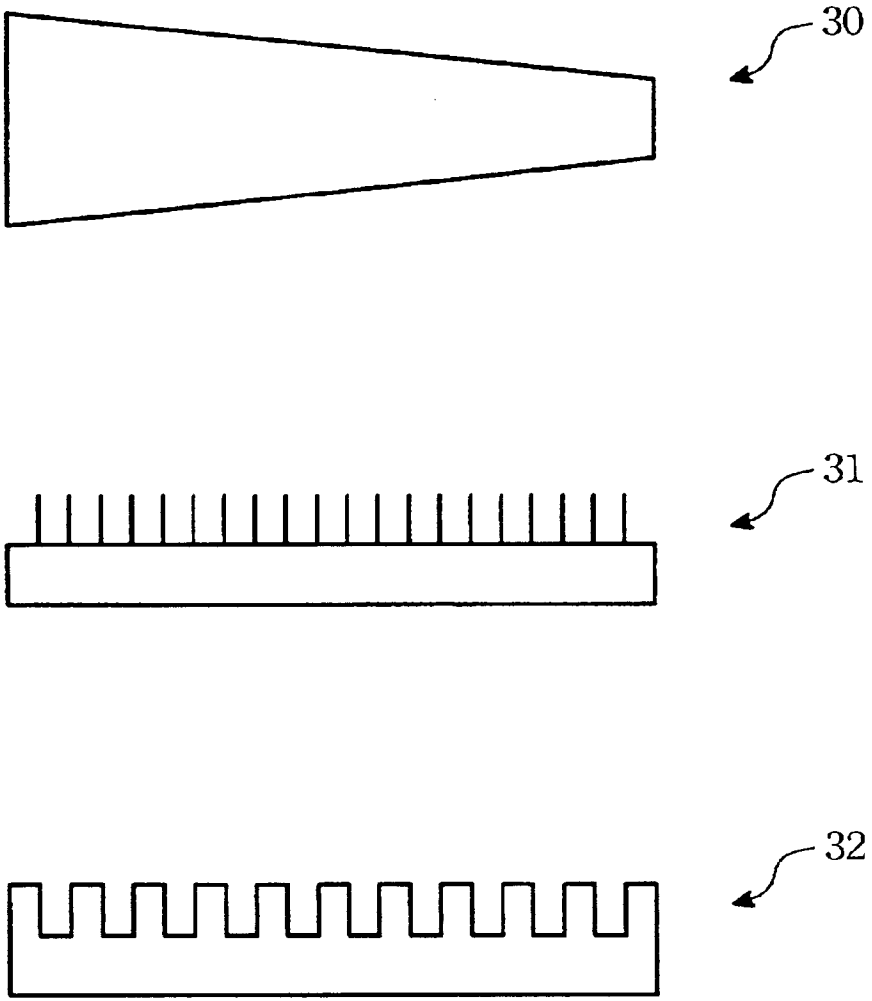
FIG. 5 is a schematic view of the varying embodiment of the shape of the micro strip conductor of the array planar antenna structure of the invention.

Referring now to FIG. 5 for the varying embodiment of the invention, the shape of the micro strip conductor of the planar antenna is not restricted to be rectangular. The shape can also be a cone type 30, a brush type 31, or a saw-toothed type 32 for increasing the operating frequency and reducing the size of the antenna.

While the preferred embodiments of the inventions have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An array planar antenna structure, comprising:

a substrate, further including a plurality of planar antennas, each of the planar antenna having a signal end and a ground end mounted on a top surface of the substrate;

a feeding micro strip conducting wire, mounted on a upper surface of the substrate and having a plurality of feeding conducting wires respectively connected with signal ends of said planar antennas; and a ground micro strip conducting wire, parallel to the feeding micro strip conducting wire and having a plurality of ground conducting wires respectively connected with the ground ends of said planar antennas;

wherein the feeding conducting wires exist between the ground conducting wires of the two neighboring planar antennas, and the ground micro strip conducting wire between said two neighboring ground conducting wires is mounted on a bottom surface of the substrate and connected with the ground conducting wires by conducting apertures.

2. The array planar antenna structure of claim 1, wherein said planar antennas are strung in row along an extended direction of the substrate.

3. The array planar antenna structure of claim 1, wherein the planar antenna is formed by two micro strip conductors, each of whose length is a multiple of ¼ wavelength, and the micro strip conductor has a signal end and a ground end respectively mounted thereon.

4. The array planar antenna structure of claim 1, wherein the upper and the bottom surfaces of the substrate respectively have a feeding power supply and a ground plate; the feeding power supply is connected electrically with the feeding micro strip conducting wire, and the ground plate is connected electrically with the ground micro strip conducting wire.

5. The array planar antenna structure of claim 1, wherein the substrate includes two collateral array planar antennas, and the feeding micro strip conducting wire is located in a middle of the substrate, and two ground micro strip conducting wires are set parallel on two sides of the feeding micro strip conducting wire.

6. The array planar antenna structure of claim 5, wherein said two collateral array planar antennas are arranged symmetrically and abreast.

7. The array planar antenna structure of claim 5, wherein said two collateral array planar antennas are arranged asymmetrically and abreast.

8. The array planar antenna structure of claim 3, wherein the shape of the micro conductor of the planar antenna is a rectangular type.

9. The array planar antenna structure of claim 3, wherein the shape of the micro conductor of the planar antenna is a cone type.

10. The array planar antenna structure of claim 3, wherein the shape of the micro conductor of the planar antenna is a brush type.

11. The array planar antenna structure of claim 3, wherein the shape of the micro conductor of the planar antenna is a saw-toothed type.

* * * * *